US011629706B2

(12) United States Patent
Li et al.

(10) Patent No.: US 11,629,706 B2
(45) Date of Patent: Apr. 18, 2023

(54) VACUUM CATHODE ARC-INDUCED PULSED THRUSTER

(71) Applicants: NATIONAL CHENG KUNG UNIVERSITY, Tainan (TW); NATIONAL APPLIED RESEARCH LABORATORIES, Taipei (TW)

(72) Inventors: Yueh-Heng Li, Tainan (TW); Sheng-Wen Liu, Tainan (TW); Hou-Yi Lee, New Taipei (TW); Tien-Chuan Kuo, Hsinchu (TW); Yao-Chung Hsu, Chiayi (TW)

(73) Assignees: National Cheng Kung University, Tainan (TW); Taiwan Space Agency, Hsinchu (TW)

( * ) Notice: Subject to any disclaimer, the term of this patent is extended or adjusted under 35 U.S.C. 154(b) by 114 days.

(21) Appl. No.: 17/374,188

(22) Filed: Jul. 13, 2021

(65) Prior Publication Data

US 2023/0019983 A1 Jan. 19, 2023

(51) Int. Cl.
*F03H 1/00* (2006.01)

(52) U.S. Cl.
CPC ..... *F03H 1/0087* (2013.01)

(58) Field of Classification Search
CPC ..... F03H 1/0087
See application file for complete search history.

(56) References Cited

U.S. PATENT DOCUMENTS 6,465,793 B1 * 10/2002 Anders ..... H01J 37/3266 250/298
2018/0244406 A1 * 8/2018 Neumann ..... F03H 1/0012

* cited by examiner

*Primary Examiner* — Ehud Gartenberg
*Assistant Examiner* — William L Breazeal
(74) *Attorney, Agent, or Firm* — Rosenberg, Klein & Lee

(57) ABSTRACT

A vacuum cathode arc-induced pulsed thruster includes a housing where a triggering room and an electric discharging room are defined and are in communication with each other, a first anode unit and a first cathode unit concentrically disposed in the triggering room, a second anode unit disposed in the electric discharging room, an insulating fuel layer concentrically located between the first anode unit and the first cathode unit, a main insulating layer concentrically surrounded by the first cathode unit, and a second cathode unit inserted from the triggering room into the electric discharging room. Thus, the vacuum cathode arc-induced pulse thruster is lightweight and has low manufacturing costs, low system complexity, and less energy consumption. Carbon deposition caused during an electric discharging process is prevented from affecting an inducing effect to thereby prolong the service life of the thruster and increase the control precision and inducing precision effectively.

5 Claims, 6 Drawing Sheets

VACUUM CATHODE ARC-INDUCED PULSED THRUSTER

BACKGROUND OF THIS INVENTION

1. Field of this Invention

This invention relates to a thruster and relates particularly to a vacuum cathode arc-induced pulsed thruster.

2. Description of the Related Art

Pulsed plasma thruster (PPT) is a new type of thruster developed in recent years. The pulsed plasma thruster is an electric propulsive thruster which accelerates the plasma by an interaction between electric field and magnetic field to create thrust. The pulsed plasma thruster is one of the most promising electric propulsive thrusters since it is lightweight and has low manufacturing costs, simple structure, and less energy consumption. Meanwhile, it can achieve a preferable effect in attitude control and station keeping for satellites. Two different prototypes of general pulsed plasma thruster are developed. One is solid fed pulsed plasma thruster. The solid fed pulsed plasma thruster has simple structure and is the most commonly used thruster. It induces the electric discharge and further creates thrust by electrodes of spark plug and propellant. However, in order to fit the requirements of inducing the electric discharge by the spark plug, extremely high voltage is needed under a vacuum environment. Further, carbon generated during an electric discharge process will deposit on surfaces of the electrodes of the spark plug and the propellant, and that will affect the electric discharge and inducing effect. Further, the service life is shortened and use efficiency is reduced greatly.

The other one is gas initiated pulsed plasma thruster. For the gas initiated pulsed plasma thruster, capacitance can cause the electric discharge when enough capacitive gas is generated between electrodes, and argon is used as both propellant and initiator for inducing the electric discharge. The capacitive gas is adapted to execute the electric discharge. When the breakdown voltage is smaller than the breakdown voltage of the atmospheric environment, the impulse generated by the maximum single pulse can achieve the effect of propulsion. However, gas propellant will consume more fuel and the propulsive efficiency is poor. Moreover, both solid fed pulsed plasma thruster and gas initiated pulsed plasma thruster will cause late-time ablation, and that will reduce the performance and service life of the thruster. Accordingly, it is an issue how to develop a thruster which has longer service life, higher performance, and lower energy consumption.

SUMMARY OF THIS INVENTION

The object of this invention is to provide a vacuum cathode arc-induced pulsed thruster capable of reducing influence of carbon deposition, converting carbon deposition into fuel, prolonging service life effectively, and increasing the control precision and inducing precision.

The vacuum cathode arc-induced pulsed thruster of this invention includes a housing where a triggering room and an electric discharging room are enclosed and a central axis is defined, a first anode unit disposed in the triggering room, a second anode unit disposed in the electric discharging room and spaced from the first anode unit, an insulating fuel layer surrounded by the first anode unit, a first cathode unit disposed in the triggering room and spaced from the first anode unit to allow the insulating fuel layer to be located between the first anode unit and the first cathode unit, a main insulating layer surrounded by the first cathode unit, and a second cathode unit disposed in the housing and inserted from the triggering room into the electric discharging room along the central axis. Meanwhile, the first anode unit, the insulating fuel layer, the first cathode unit, and the main insulating layer are in concentric relationship with one another around the central axis of the housing. Therefore, after the first anode unit and the first cathode unit interact and induce the electric discharge, the insulating fuel layer located between the first anode unit and the first cathode unit is induced to generate plasma. The plasma then enters into the electric discharging room. The second anode unit and the second cathode unit further interact and induce the electric discharge to allow the high-speed exhaust velocity of metal ions in the plasma to generate thrust. Thus, no additional element such as spark plug is needed. The vacuum cathode arc-induced pulsed thruster is lightweight and has low manufacturing costs, low system complexity, and less energy consumption. Carbon deposition caused during an electric discharging process is prevented from affecting an inducing effect to thereby convert carbon deposition into fuel, prolong the service life of the thruster and increase the control precision and inducing precision effectively.

Preferably, a control device is connected to the first anode unit, the first cathode unit, the second anode unit, and the second cathode unit respectively.

Preferably, the insulating fuel layer is made of Polytetrafluoroethylene (sold under the trademark TEFLON™).

Preferably, a partitioning unit projects from the inner peripheral wall of the housing in order that the first anode unit and the second anode unit are spaced from each other.

Preferably, the partitioning unit tapers from the triggering room to the electric discharging room.

DETAILED DESCRIPTION OF THE PREFERRED EMBODIMENTS

Figure 1:
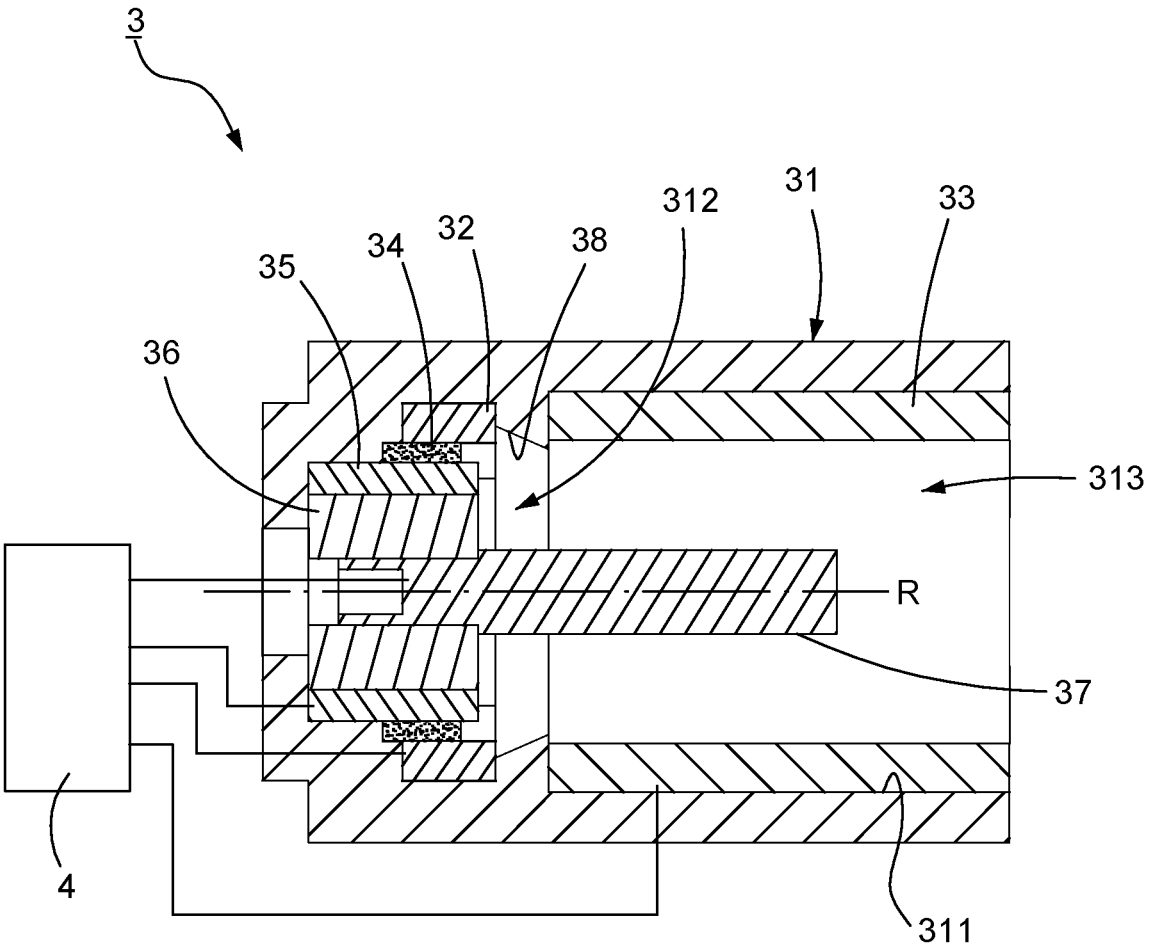
FIG. 1 is a cross-sectional view showing a first preferred embodiment of this invention.
Figure 2:
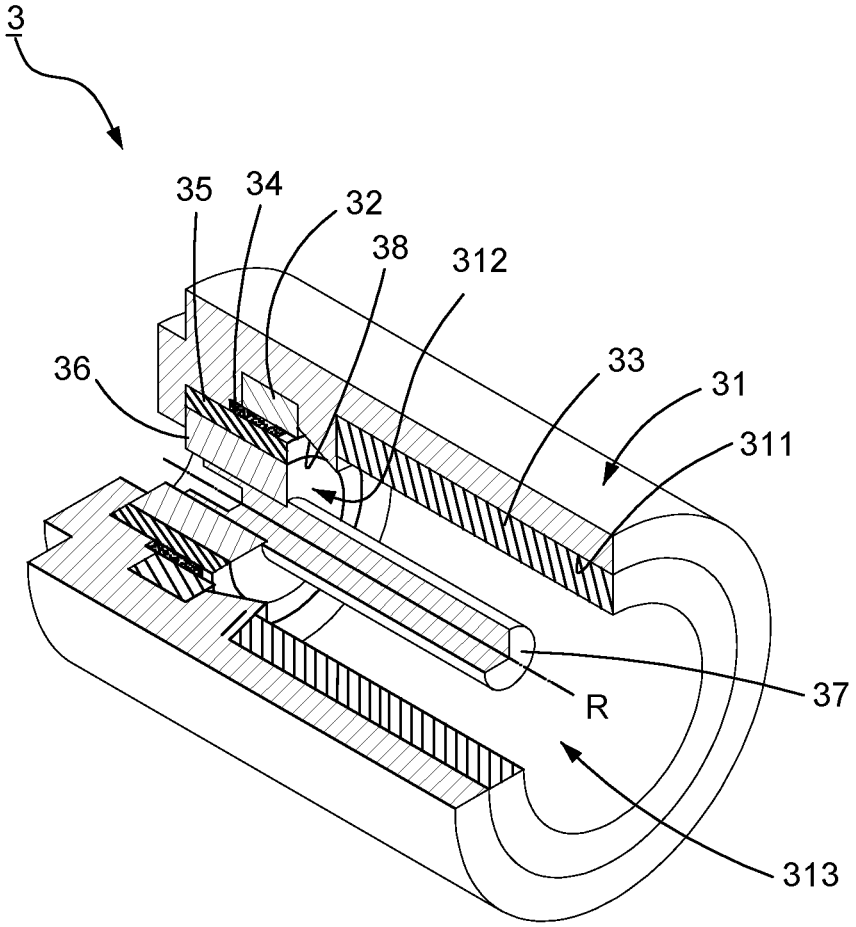
FIG. 2 is a perspective view showing the first preferred embodiment of this invention.

Referring to FIG. 1 and FIG. 2, a vacuum cathode arc-induced pulsed thruster 3 of a first preferred embodiment of this invention comprises a housing 31 defining a central axis R and having an inner peripheral wall 311 which encloses a triggering room 312 and an electric discharging room 313 respectively, a first anode unit 32 disposed in the triggering room 312 and fitting the inner peripheral wall 311 of the housing 31, a second anode unit 33 disposed in the electric discharging room 313 and fitting the inner peripheral wall 311 of the housing 31, an insulating fuel layer 34 surrounded by the first anode unit 32, a first cathode unit 35 disposed in the triggering room 312 and spaced from the first anode unit 32 to allow the insulating fuel layer 34 to be located between the first anode unit 32 and the first cathode unit 35, a main insulating layer 36 surrounded by the first cathode unit 35, and a second cathode unit 37 disposed in the housing 31 and inserted from the triggering room 312 into the electric discharging room 313 along the central axis R. The first anode unit 32 and the second anode unit 33 are spaced from each other. The triggering room 312 and the electric discharging room 313 are in communication with each other. Further, the first anode unit 32, the insulating fuel layer 34, the first cathode unit 35, and the main insulating layer 36 are in concentric relationship with one another around the central axis R of the housing 31. In this preferred embodiment, the insulating fuel layer 34 is made of a Polytetrafluoroethylene (sold under the trademark TEFLON™).

In this preferred embodiment, a partitioning unit 38 projects from the inner peripheral wall 311 of the housing 31 so that the first anode unit 32 and the second anode unit 33 are spaced from each other. Meanwhile, the partitioning unit 38 tapers from the triggering room 312 to the electric discharging room 313. A control device 4 is connected to the first anode unit 32, the first cathode unit 35, the second anode unit 33, and the second cathode unit 37 respectively. The control device 4 can input positive voltage into the first anode unit 32 and the second anode unit 33 and input negative voltage into the first cathode unit 35 and the second cathode unit 37 to thereby control the first anode unit 32 and the first cathode unit 35 to execute the electric discharge and control the second anode unit 33 and the second cathode unit 37 to execute the electric discharge.

Figure 3:
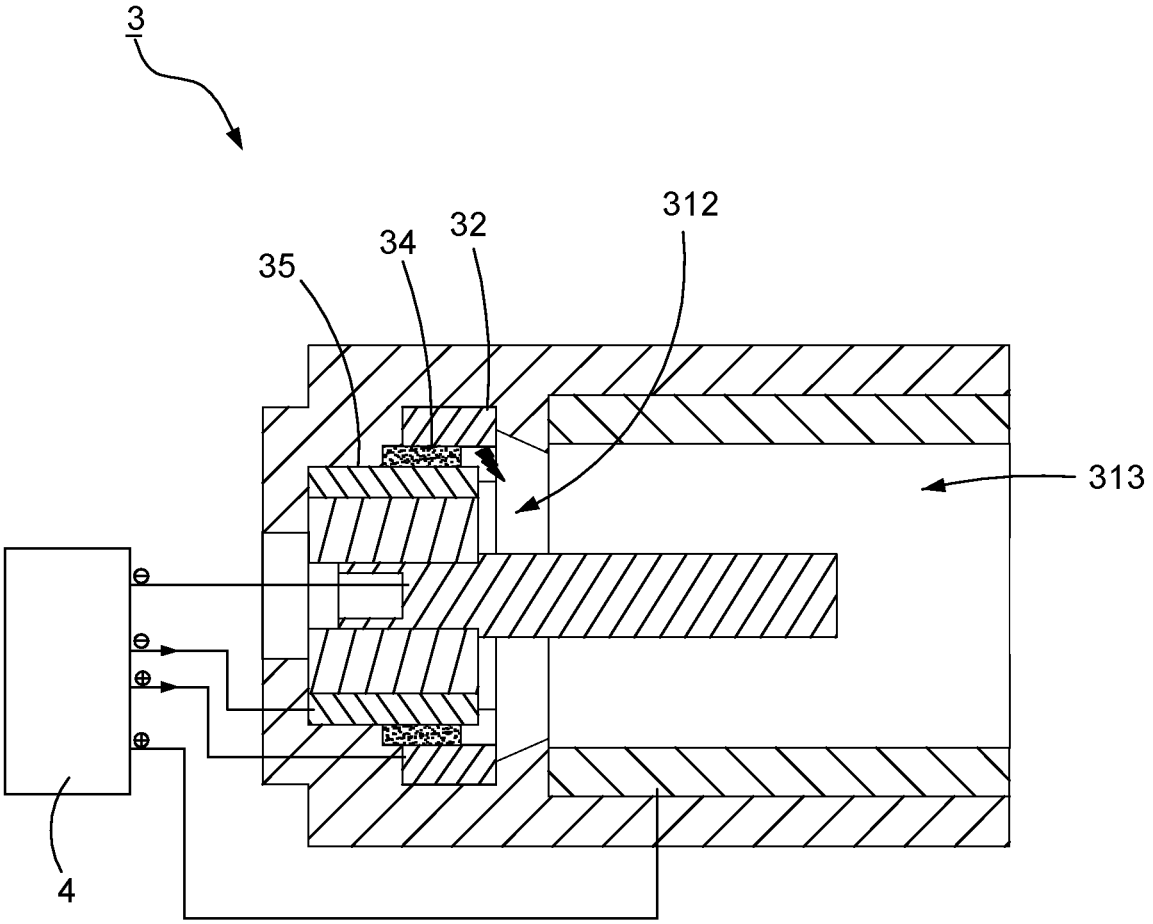
FIG. 3 is a schematic view showing the first anode unit and the first cathode unit interact and induce the electric discharge.
Figure 4:
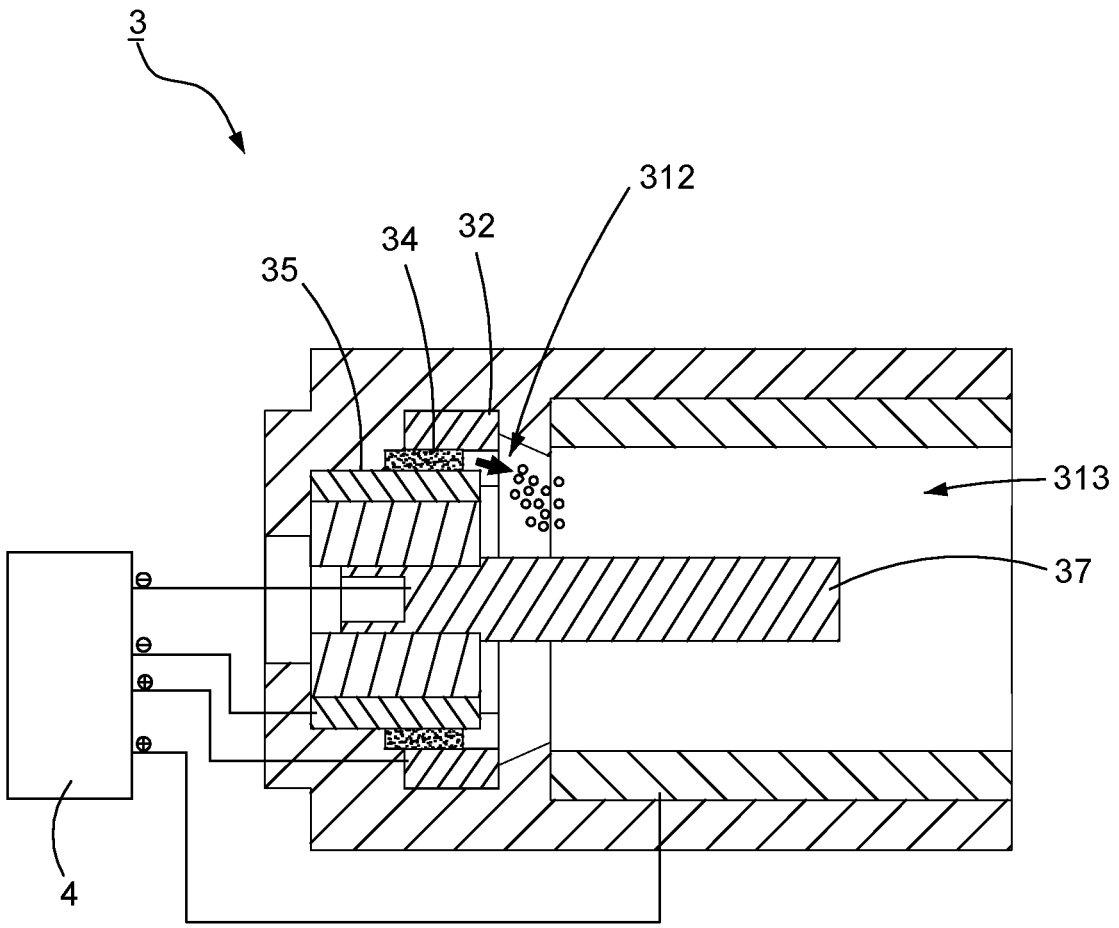
FIG. 4 is a schematic view showing the plasma is generated.

Referring to FIG. 3 and FIG. 4, during an operation of the vacuum cathode arc-induced pulsed thruster 3, the control device 4 controls the first anode unit 32 and the first cathode unit 35 to interact and induce the electric discharge to thereby generate an electric arc between the first anode unit 32 and the first cathode unit 35. The electric arc is concentrated on a surface of the first cathode unit 35 to form a cathode spot. The extremely high temperature of the cathode spot then causes the thermionic emission and generates plasma. The plasma is further discharged to the triggering room 312 to thereby generate thrust initially. Meanwhile, the plasma is generated from the micro-explosion and the evaporation of the first cathode unit 35, and that will consume carbon formed the surface of the first cathode unit 35 and a surface of the insulating fuel layer 34.

Figure 5:
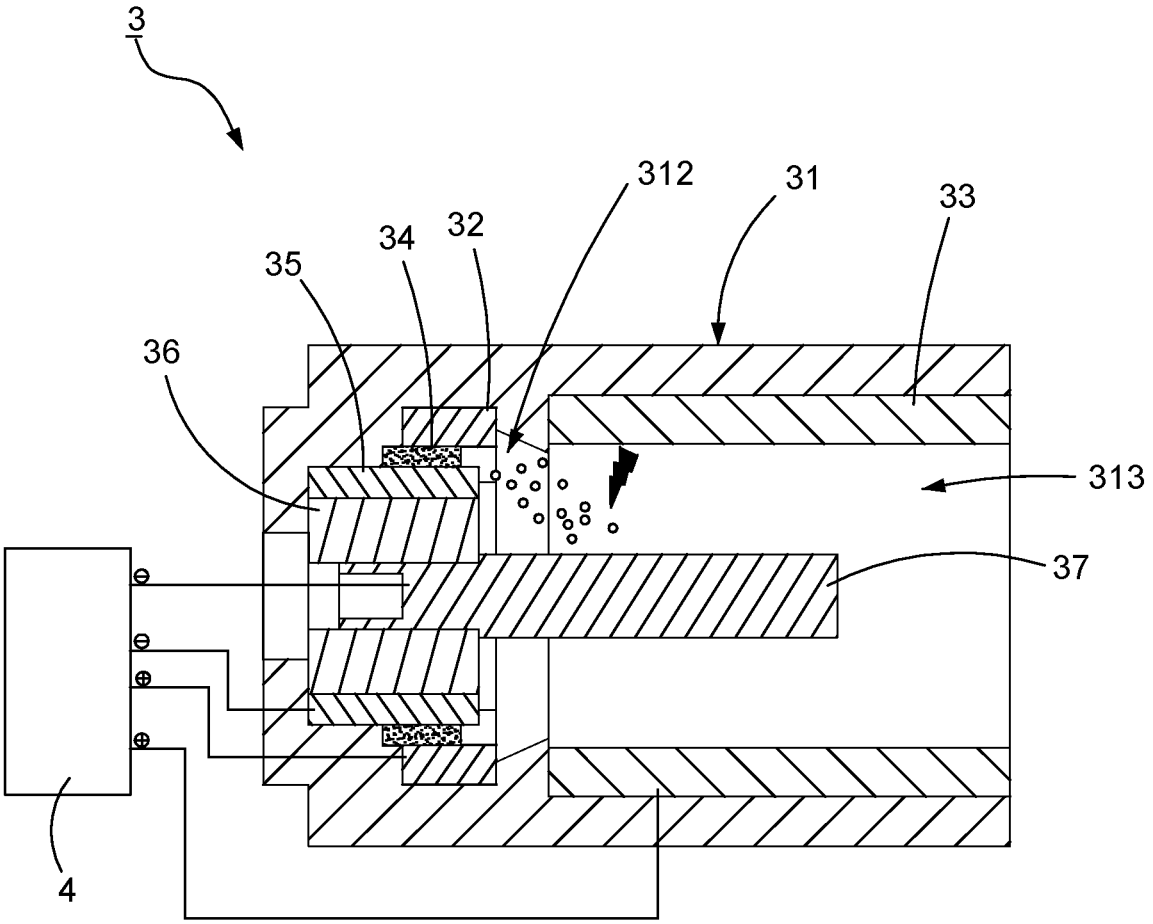
FIG. 5 is a schematic view showing the plasma enters into the electric discharging room from the triggering room and forms a channel.
Figure 6:
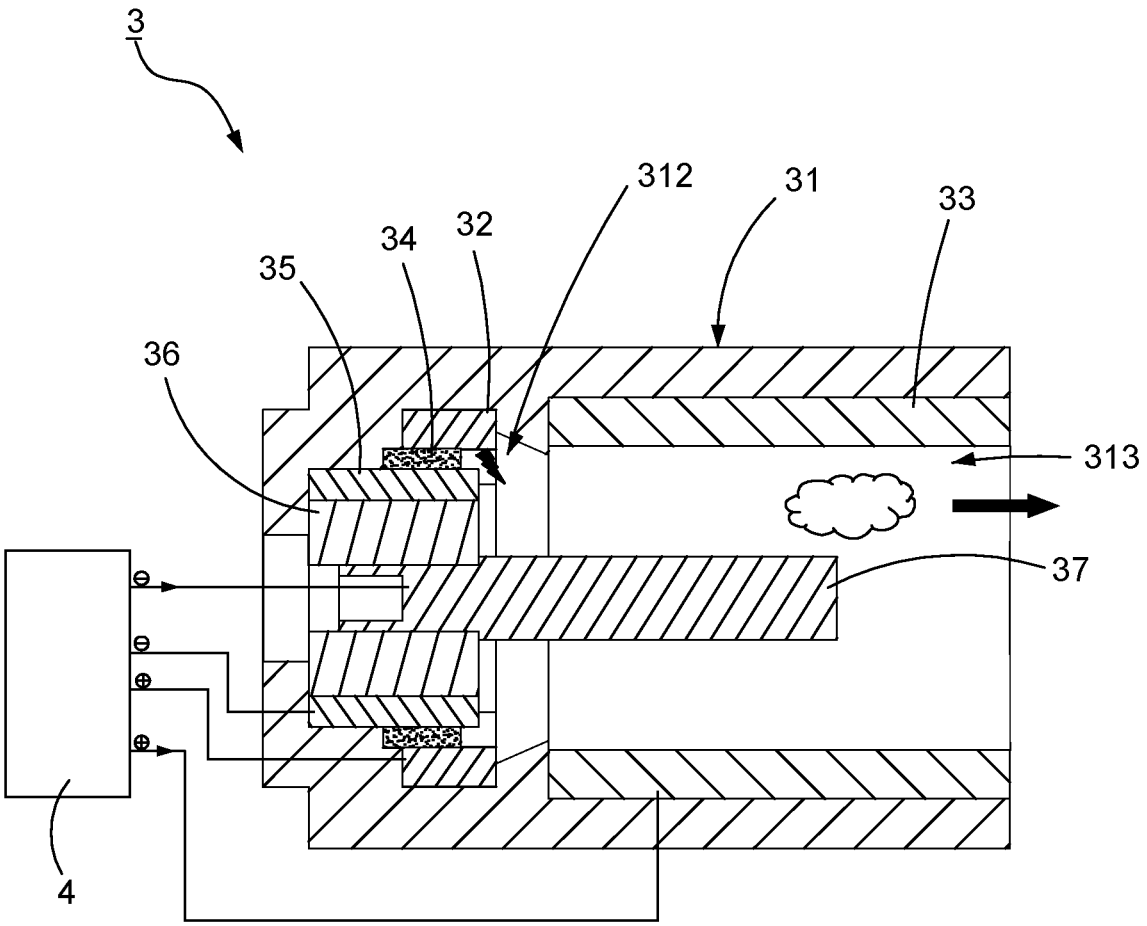
FIG. 6 is a schematic view showing the second anode unit and the second cathode unit interact and induce the electric discharge and generate thrust.

Referring to FIG. 5 and FIG. 6, the plasma enters into the electric discharging room 313 from the triggering room 312 to thereby form a channel in the electric discharging room 313. Simultaneously, the control device 4 actuates the second anode unit 33 and the second cathode unit 37 to interact and induce the electric discharge. The electric discharge then allows the plasma in the electric discharging room 313 to induce an interaction of electric field and magnetic field to further generate Lorentz force and accelerate the thrust. Moreover, because the insulating fuel layer 34 is made of Polytetrafluoroethylene (sold under the trademark TEFLON™), part of carbon will deposit on the surface of the first cathode unit 35 and the surface of the insulating fuel layer 34 when the plasma is generated from the electric arc to thereby resupply the carbon of the first cathode unit 35 and the insulating fuel layer 34. Thus, the carbon deposition in this invention will not affect the inducing effect and the electric discharge. Further, it can help resupply the carbon of the first cathode unit 35 and the insulating fuel layer 34 to thereby prolong the service life of the first cathode unit 35 and the insulating fuel layer 34. Hence, this invention is unlike the conventional thruster which needs extremely high voltage to induce the electric discharge by the spark plug. Meanwhile, the vacuum cathode arc-induced pulsed thruster 3 can avoid the deficiency of poor fire-lighting effect caused when the electrodes of the spark plug of the conventional thruster is covered by carbon. Thus, the vacuum cathode arc-induced pulsed thruster 3 can increase the control precision and inducing precision without being affected by the carbon deposition.

To sum up, the vacuum cathode arc-induced pulsed thruster of this invention takes an advantage of the entire structure which has the housing enclosing the electric discharging room and the triggering room and defining the central axis, the first anode unit and the second anode unit respectively disposed in the triggering room and the electric discharging room, the insulating fuel layer enclosed by the first anode unit, the first cathode unit disposed in the triggering room and spaced from the first anode unit to allow the insulating fuel layer located between the first anode unit and the first cathode unit, the main insulating layer enclosed by the first cathode unit, and the second cathode unit penetrating from the triggering room into the electric discharging room along the central axis to thereby be lightweight and have low manufacturing costs, low system complexity, and less energy consumption. Further, carbon deposition caused during an electric discharging process is prevented from affecting an inducing effect to thereby prolong the service life of the thruster and increase the control precision and inducing precision effectively.

While the embodiments of this invention are shown and described, it is understood that further variations and modifications may be made without departing from the scope of this invention.

What is claimed is:

1. A vacuum cathode arc-induced pulsed thruster comprising:

a housing defining a central axis and having an inner peripheral wall, with a triggering room and an electric discharging room respectively enclosed by said inner peripheral wall, said triggering room and said electric discharging room being in communication with each other;

a first anode unit and a second anode unit respectively disposed in said triggering room and said electric discharging room, said first anode unit and said second anode unit fitting said inner peripheral wall of said housing respectively and spaced from each other;

an insulating fuel layer surrounded by said first anode unit;

a first cathode unit disposed in said triggering room and spaced from said first anode unit, with said insulating fuel layer located between said first anode unit and said first cathode unit;

a main insulating layer surrounded by said first cathode unit; and a second cathode unit disposed in said housing and inserted from said triggering room into said electric discharging room along said central axis;

wherein said first anode unit, said insulating fuel layer, said first cathode unit, and said main insulating layer are in concentric relationship with one another around said central axis of said housing.

2. The vacuum cathode arc-induced pulsed thruster according to claim 1, further comprising a control device connected to said first anode unit, said first cathode unit, said second anode unit, and said second cathode unit respectively.

3. The vacuum cathode arc-induced pulsed thruster according to claim 1, wherein said insulating fuel layer is made of Polytetrafluoroethylene (sold under the trademark TEFLON™).

4. The vacuum cathode arc-induced pulsed thruster according to claim 1, wherein a partitioning unit projects from said inner peripheral wall of said housing so that said first anode unit and said second anode unit are spaced from each other.

5. The vacuum cathode arc-induced pulsed thruster according to claim 4, wherein said partitioning unit tapers from said triggering room to said electric discharging room.

* * * * *